US005409551A

United States Patent [19]

Azuma et al.

[11] Patent Number: 5,409,551

[45] Date of Patent: Apr. 25, 1995

[54] METHOD FOR MINIMIZING SURFACE ROUGHENING OF TUNGSTEN-CONTAINING ROLLS AND OTHER METALLIC ARTICLES

[75] Inventors: Shigeki Azuma; Yoshiaki Kusaba; Hideaki Miyuki, all of Kobe; Hideo Yamamoto, Takarazuka, all of Japan

[73] Assignee: Sumitomo Metal Industries, Ltd., Osaka, Japan

[21] Appl. No.: 971,215

[22] Filed: Nov. 4, 1992

[30] Foreign Application Priority Data

Nov. 6, 1991 [JP] Japan ..... 3-290180

[51] Int. Cl.[6] ..... C23C 22/00

[52] U.S. Cl. ..... 148/281; 148/243

[58] Field of Search ..... 148/240, 243, 281, 241

[56] References Cited

U.S. PATENT DOCUMENTS

| | | | |
|---|---|---|---|
| 2,653,882 | 9/1953 | Treseder | 148/243 |
| 4,355,079 | 10/1982 | Rosenberg et al. | 148/243 |
| 4,818,572 | 4/1989 | Shimamune et al. | 148/281 |

FOREIGN PATENT DOCUMENTS

| | | | |
|---|---|---|---|
| 0008211 | 2/1980 | European Pat. Off. . | |
| 0146284 | 6/1985 | European Pat. Off. . | |
| 698910 | 10/1953 | United Kingdom . | |
| 1011715 | 12/1965 | United Kingdom | 148/281 |

OTHER PUBLICATIONS

"Evolution of Steel Wire Hot Rolling Rolls", Niibayashi et al., printed in a company journal of Sumitomo Electric Industry, Japan, No. 123, pp. 113–122 Sep. 1958.

*Primary Examiner*—Scott Kastler

*Attorney, Agent, or Firm*—Burns, Doane, Swecker & Mathis

[57] ABSTRACT

A method for improving the resistance to surface roughening of tungsten-containing metallic articles such as cutting tools and hot mill rolls made of a cemented carbide or high-speed steel and extending the lifetime thereof. The method comprises treating a metallic article with an aqueous alkaline solution containing calcium ions and optionally tungstate ions having a pH greater than 8 so as to form a coating of calcium tungstate on the surface of the metallic article. In hot rolling with tungsten-containing rolls, the aqueous solution can be used as at least part of a cooling water to cool the rolls, thereby extending the period before roll replacement becomes necessary due to surface roughening and decreasing the frequency of roll dressing required during hot rolling.

20 Claims, 2 Drawing Sheets

METHOD FOR MINIMIZING SURFACE ROUGHENING OF TUNGSTEN-CONTAINING ROLLS AND OTHER METALLIC ARTICLES

BACKGROUND OF THE INVENTION

The present invention relates to a method for minimizing surface roughening of metallic articles made of tungsten-containing alloys such as cemented carbides or high-speed steels. More particularly, it is concerned with a method for improving the resistance to surface roughening of tungsten-containing metallic article such as mill rolls and cutting tools. The invention also relates to a tungsten-containing metallic article having improved resistance to surface roughening and a method for retarding surface-roughening of tungsten-containing hot mill rolls during hot rolling.

Most cutting tools have tips made of tungsten-containing alloys which include high-speed steels and cemented tungsten carbide hard alloys. High-speed steels (also called high-speed tool steels) usually contain a considerable amount (generally 5–22% by weight) of W and one or more other alloying elements such as Mo, Cr, V, and Co. Cemented carbide alloys are composite alloys predominantly comprising tungsten carbide (WC) particles which are sintered with one or more binder metals such as Ni, Co, and the like. These two types of tungsten-containing alloys are both very expensive due to their high contents of expensive metals such as tungsten, nickel, and cobalt. Therefore, many alloy designs have been proposed with respect to tungsten-containing alloys for cutting tools in order to extend the lifetime of the tools and improve the cuttability thereof.

Mill rolls used in rolling of steel products are made of various materials. High-speed steels and cemented tungsten carbide hard alloys are mainly used in mill rolls for finish rolling and especially finish hot rolling for high-strength wire rods. Surface roughening of rolls is crucial particularly in finish rolling since surface gloss and smoothness are important properties for steel products and any surface roughness and flaws on the surface of finish rolls are printed onto rolled steel products. Therefore, it is important that rolls for finish rolling have a smooth roll surface.

In order to cool hot mill rolls, industrial water normally available in the factory has conventionally been used without treatment. However, as reported in Sumitomo Electric (a company journal of Sumitomo Electric Industry, Japan), No. 123, page 113, the rolls suffer surface roughening primarily due to corrosion in a relatively short period during hot rolling, resulting in a deterioration in surface appearance of rolled products.

In order to dress the roughened roll surface, the rolling operation must be interrupted after a short period, e.g., 2 hours and the surface-roughened rolls are detached for replacement by another set of rolls and subjected to a surface dressing procedure such as grinding and electrolytic polishing to restore the damaged roll surface to a smooth surface. This dressing procedure, which must be repeated frequently during hot rolling is a serious problem in a hot rolling operation since it leads to a significant decrease in operating efficiency. Such frequent dressing of rolls also results in a decreased lifetime of rolls made of a tungsten-containing alloy, which are much more expensive than conventional cast steel rolls, and therefore increases operating costs.

SUMMARY OF THE INVENTION

It is an object of the present invention to provide a method for improving the resistance to surface roughening of expensive tungsten-containing metallic articles such as cutting tools and mill rolls so as to extend the lifetimes of these articles.

Another object of the invention is to provide a tungsten-containing metallic article having improved resistance to surface roughening.

A further object of the invention is to provide a method for retarding surface roughening of tungsten-containing hot mill rolls during rolling operations so as to minimize the frequency of roll dressing and improve the rolling efficiency.

A more specific object of the invention is to provide a method for minimizing surface roughening of a tungsten-containing metallic article by forming on the surface thereof a coating effective for inhibition of surface roughening.

It has been found that when a tungsten-containing metallic article is treated with an aqueous solution containing calcium ions ($Ca^{2+}$), calcium tungstate crystals are precipitated on the metal surface of the article so as to form a coating of these crystals. This coating effectively protects the metal surface from wearing and retards surface toughening of the metallic article.

It has also been found that if the tungsten content of the metallic article is insufficient to form a calcium tungstate coating, effective inhibition of surface roughening can be attained by adding tungstate ions ($WO_4^{2-}$) to the aqueous solution with which the metallic article is treated.

When the metallic article is a hot mill roll, surface roughening of the roll can be retarded by using a cooling water containing calcium ions or calcium ions and tungstate ions to cool the roll during hot rolling.

Thus, in one aspect, the present invention provides a method for improving the resistance to surface roughening of tungsten-containing metallic articles, comprising treating a tungsten-containing metallic article with an aqueous alkaline solution containing calcium ions and having a pH greater than 8 so as to form a coating of calcium tungstate on the surface of the metallic article.

In another aspect, the present invention provides a method for retarding surface roughening of tungsten-containing hot mill rolls, comprising substituting an aqueous alkaline solution containing calcium ions and having a pH greater than 8 for at least part of the cooling water used to cool the rolls during hot rolling.

The present invention also relates to a tungsten-containing metallic article having improved resistance to surface roughening, characterized by having a calcium tungstate coating on the surface thereof.

The aqueous alkaline solution may further contain tungstate ions in addition to calcium ions, particularly when the tungsten content of the metallic article or hot mill rolls is relatively low.

DESCRIPTION OF THE INVENTION

In order to investigate the corrosion behavior of tungsten-containing metallic articles in a calcium ion-containing aqueous solution, plates of a cemented tungsten carbide hard alloy, which is a representative tungsten-containing mill roll material and which had the chemical composition shown in Table 1, were immersed in aqueous solutions with various pH values and with various contents of calcium ions under the conditions shown in Table 2.

TABLE 1

| Chemical Composition of Test Material (wt %) | | | |
|---|---|---|---|
| WC | Co | Ni | Cr |
| 87 | 6 | 6 | 1 |

TABLE 2

| Immersion Conditions | |
|---|---|
| Temperature: | 150° C. |
| Immersion period: | 24 hours |
| Atmosphere: | Not deaerated |
| pH adjustment | |
| Acidic: | Acetic acid-sodium acetate buffer |
| Alkaline: | Boric acid-sodium hydroxide buffer |
| Calcium ions: | Added as calcium sulfate |
| Proportion of solution: | 50 cc/cm$^2$ of test plate |

After the immersion, the surface appearance of each test material was observed under a scanning electron microscope and the surface deposits formed on the test material were analyzed by an X-ray microanalyzer. The amounts of tungsten and nickel dissolved in the aqueous solution from the test material during immersion were determined by emission spectrum analysis of elements with inductively coupled plasma.

Figure 1:
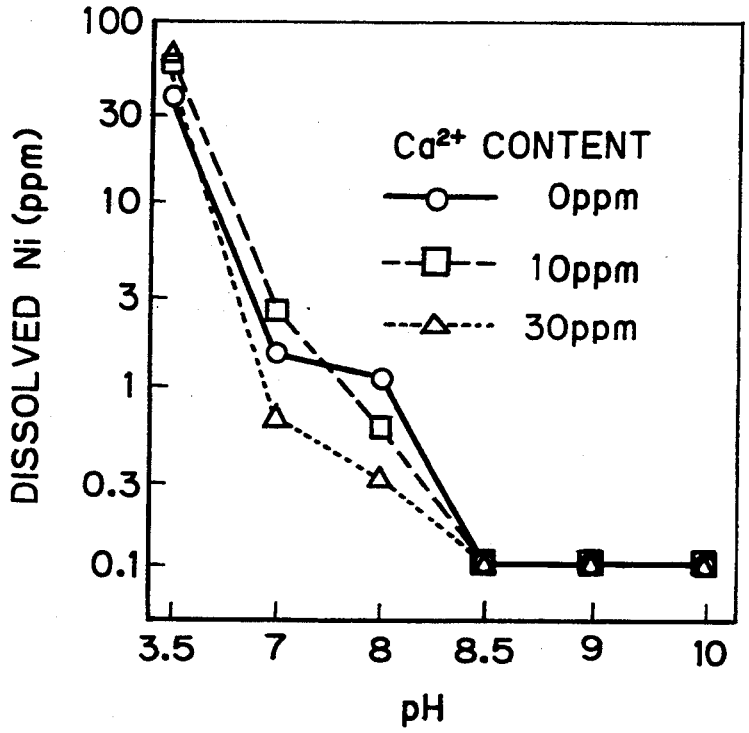
FIG. 1 is a graph showing the effect of solution pH on the amount of Ni dissolved from a cemented tungsten carbide hard alloy during immersion when the alloy is immersed in an aqueous solution containing various amounts of calcium ions.
Figure 3:
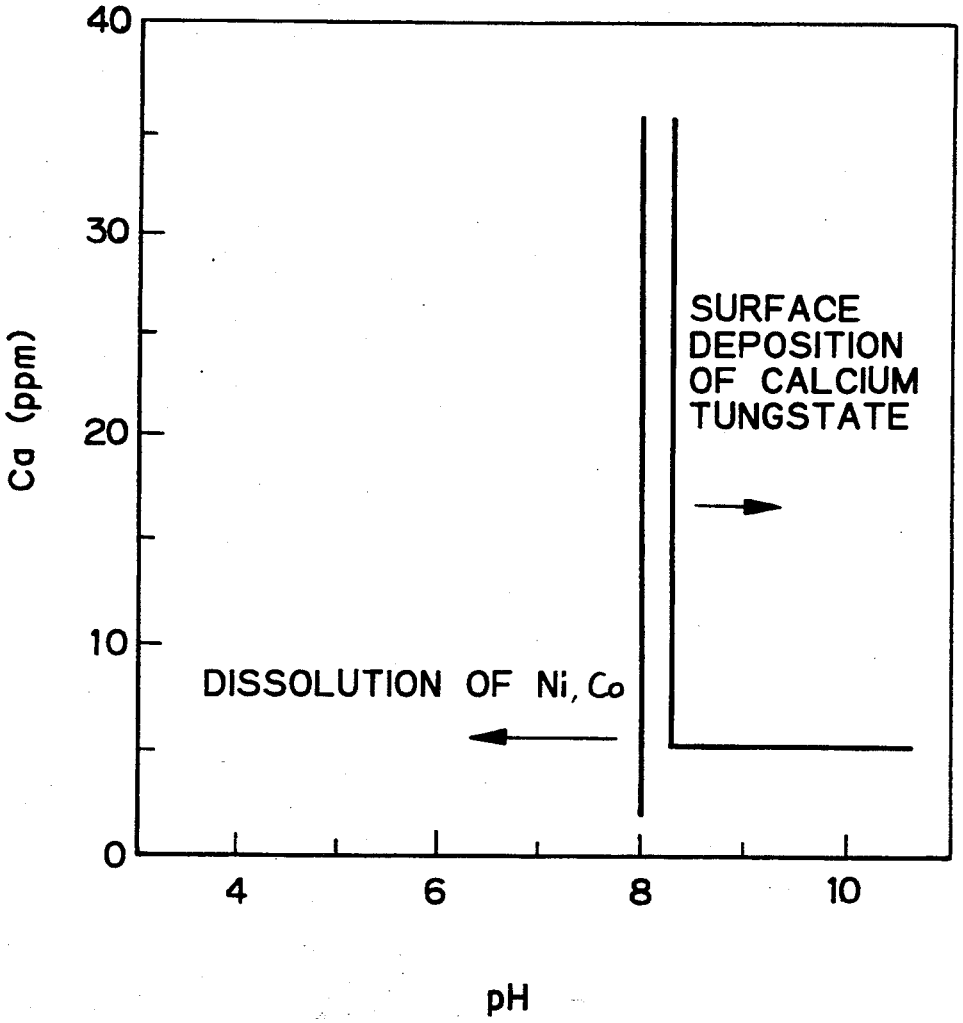
FIG. 3 is a schematic illustration of the corrosion behavior of the alloy as a function of pH and calcium ion content of the solution.

As shown in FIG. 1, the amount of dissolved nickel which was present in the alloy as a binder metal increased as the solution pH decreased in the acidic pH range, indicating that dissolution of the alloy matrix (binder metals such as Ni and Co) rather than tungsten carbide particles occurred in an acidic solution, as illustrated in FIG. 3. There was no significant effect of the addition of calcium ions to the solution on the amount of dissolved nickel.

Figure 2:
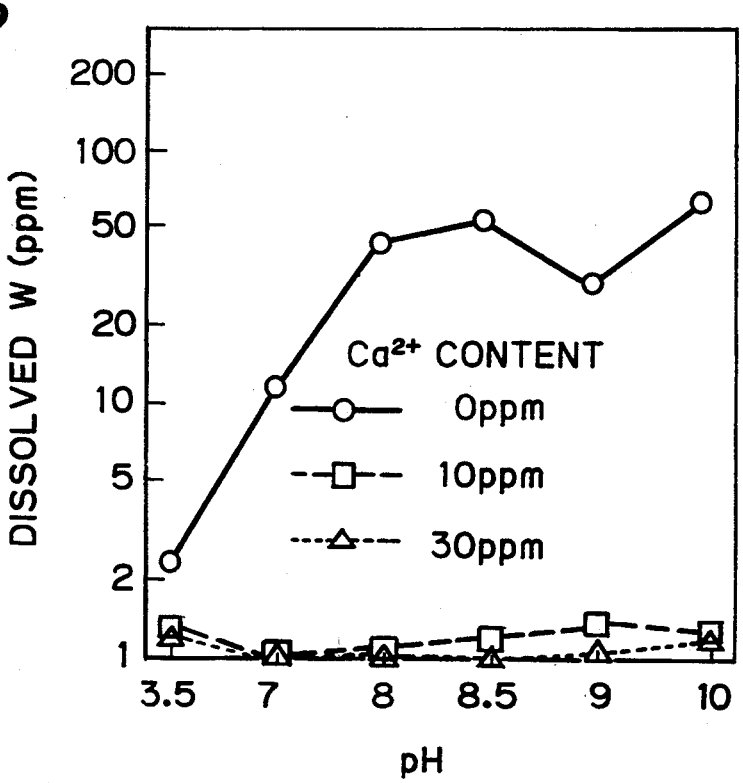
FIG. 2 is a graph showing the effect of solution pH on the amount of W dissolved from the cemented carbide alloy during immersion.

On the other hand, as shown in FIG. 2, the amount of dissolved tungsten increased as the solution pH increased in the alkaline pH range when the solution did not contain calcium ions. However, when the aqueous solution in which the alloy was immersed contained calcium ions, the amount of dissolved tungsten significantly decreased even in the alkaline pH range, indicating that the addition of calcium ions to the solution is effective for inhibition of dissolution of tungsten.

FIG. 3 schematically illustrates the overall results of the surface deposit analysis and solution analysis. As shown in this figure, when the cemented tungsten carbide hard alloy was immersed in an aqueous alkaline calcium ion-containing solution at a pH greater than 8, crystals of calcium tungstate were deposited on the metal surface. The reaction mechanism is thought to be depicted by the following scheme.

$$W_{(WC)} + 8OH^- \rightarrow WO_4^{2-} + 4H_2O + 6e^- \quad (1)$$

$$WO_4^{2-} + Ca^{2+} \rightarrow CaWO_4 \downarrow \quad (2)$$

Thus, tungsten present in the tungsten carbide particles which are dispersed in the cemented carbide alloy is dissolved in the alkaline solution to form tungstate ions and the resulting tungstate ions are reacted with calcium ions present in the solution to precipitate calcium tungstate crystals, which are deposited on the metal surface.

The deposited calcium tungstate is hardly soluble in water. Therefore once the metal surface is covered with crystals of calcium tungstate, it functions as a protecting coating to inhibit subsequent corrosion of the metallic article and retard surface roughening thereof.

Accordingly, when a tungsten-containing metallic article is treated with an aqueous calcium ion-containing alkaline solution having a pH higher than 8 in accordance with the present invention, a coating of calcium tungstate is formed on the surface of the metallic article, thereby significantly improving the resistance to surface roughening of the article.

The treatment of the present invention is applicable to any tungsten-containing metallic article. Examples of such a metallic article include cutting tools or tips thereof made of a cemented tungsten carbide hard alloy or a tungsten-containing high-speed steel as well as hot mill rolls made of the above-described hard alloy or high-speed steel, which are used especially in finish rolling of wire rod. The tungsten content of the metallic article is not critical, but it is preferably 8% or more and more preferably 20% or more by weight.

The aqueous calcium ion-containing solution used to treat the metallic article has an alkaline pH which is higher than 8 and preferably 8.5 or higher. Such an alkaline pH is selected in order to suppress the dissolution of Ni, Co and other metals present in the metallic article since these metals are dissolved from the metallic article during immersion in an acidic solution, as described above. There is no particular upper limit to the pH value of the solution, but it is generally preferable that the solution pH be 9 or below since the amount of dissolved tungsten tends to increase when the aqueous solution has an extremely high pH value.

As can be understood from the foregoing reaction equation (1), dissolution of tungsten is accompanied by a loss of hydroxide ions. However, since the amount of tungsten dissolved into the aqueous alkaline solution during treatment is slight, it is usually not necessary to use a buffer in order to keep the solution at a constant pH. Nevertheless, if desired, a buffer can be present in the aqueous solution so as to maintain a constant pH.

The content of calcium ions in the aqueous alkaline solution is not critical. This is because the solubility of calcium tungstate to be precipitated from the solution is as low as 6.4 mg/l. Consequently the presence of a very slight amount of calcium ions in the solution is sufficient to deposit calcium tungstate on the surface of a tungsten-containing metallic article treated with the solution.

Preferably, the content of calcium ions in the aqueous alkaline solution is at least 10 ppm and more preferably between 30 and 80 ppm. As the source of calcium ions, any water-soluble calcium compound can be used. For example, calcium sulfate and calcium nitrate can be used.

In those cases where the metallic article to be treated with the aqueous solution has a relatively low tungsten content, such as is the case with high-speed steels in which the tungsten content is usually less than 20% by weight, the amount of tungsten dissolved from the metallic article by the reaction of the foregoing equation (1) may not be large enough to deposit calcium tungstate on the surface of the article in an amount sufficient to significantly improve the resistance to surface roughening of the article. In such cases, it is preferred that a source of tungstate ions be added to the aqueous solution in order to ensure that calcium tungstate is deposited on the metal surface in an amount sufficient for adequate improvement in resistance to surface roughening thereof.

The amount of tungstate ions, if added to the aqueous solution, is not critical, but preferably it is a slight amount on the order of 10 ppm or higher and more preferably between 20–50 ppm. The addition of an increased amount of tungstate ions causes precipitation of calcium tungstate in the solution by a reaction with calcium ions present therein, leading to an increase in the amount of waste tungstate and calcium ions which will not be used in the subsequent treatment of metallic articles to form a coating of calcium tungstate thereon. Preferable sources of tungstate ions are alkali metal salts of tungstic acid such as sodium tungstate and potassium tungstate.

When the tungsten content of the metallic article is as high as 20% by weight or more, as is the case with cemented tungsten carbide hard alloys, the amount of tungsten dissolved from the article according to the reaction of equation (1) is sufficient to improve the resistance to surface roughening of the article. In such cases, therefore, it is usually unnecessary to add tungstate ions to the aqueous solution used to treat the metallic article.

In addition to calcium ions and optionally added tungstate ions, the aqueous alkaline solution used to treat a tungsten-containing metallic article may further contain additional cations and anions as long as they do not adversely affect the precipitation of calcium tungstate on the surface of the article. Examples of additional cations include sodium or potassium ions which may be added for pH adjustment or introduced to the solution by the source of tungstate ions. Examples of additional anions include chloride, sulfate, or phosphate ions which may be introduced to the solution by the source of calcium ions.

The treatment of a tungsten-containing metallic article with the aqueous alkaline calcium ion-containing solution may be performed by immersion, spraying, coating, or similar method. Immersion is the most efficient method. The treating temperature is preferably in the range of 80°–200° C. and more preferably 120°–180° C. The duration of treatment (treating period) depends on the temperature, treating method, and other treating conditions and is usually between 3 and 24 hours.

Tungsten-containing metallic articles which have been treated with an aqueous alkaline calcium ion-containing solution according to the present invention prior to use have a coating of calcium tungstate deposited on the surface thereof. This coating provides the article with improved resistance to surface toughening during use. As a result, when the metallic articles are cutting tools or tips thereof, they have a significantly extended lifetime. In the case of mill rolls, the period before replacement of the rolls becomes necessary due to surface roughening is extended. In other words, the frequency of roll dressing is decreased. In either case, the costs and operating efficiency are greatly improved. If necessary, the metallic articles may be treated in accordance with the present invention at any opportunity while in use in order to restore or further improve the resistance to surface roughening.

The improvement in resistance to surface roughening according to the present invention can be achieved with hot rolling using tungsten-containing mill rolls, for example, in finish rolling of wire rod. In this embodiment of the present invention, hot rolling is performed by using an aqueous alkaline calcium ion-containing solution as a cooling water which is usually sprayed onto the rolls. In other words, a source of calcium ions and, if necessary, other additives such as a pH-adjuster and a source of tungstate ions are added to the cooling water used to cool the rolls during hot rolling.

Also in this case, crystals of calcium tungstate are precipitated on the surface of the tungsten-containing rolls so as to form a coating of calcium tungstate thereon, thereby retarding surface roughening of the roll. As a result, the period before replacement of the rolls becomes necessary in hot rolling operation is greatly extended and the frequency of roll dressing, which requires complicated operations, is significantly decreased, leading to a significant improvement in operating efficiency.

The aqueous alkaline calcium ion-containing solution may be substituted for all the cooling water used to cool the rolls during hot rolling. Alternatively, part of the cooling water may be replaced by such an aqueous calcium ion-containing solution and even in this case it is possible to retard surface roughening of the rolls to a substantial degree.

Again in this embodiment of the present invention, when the tungsten-containing hot mill rolls has a chemical composition with a relatively low tungsten content, e.g., less than 20% and especially less than 15% by weight as is the case with high-speed steels, it is preferred that the aqueous solution used as a cooling water contain tungstate ions in addition to calcium ions. In the cases, where the rolls are made of a cemented tungsten carbide hard alloy or similar high-tungsten alloy having a tungsten content of more than 20% and especially more than 30% by weight, there is no need, as a rule, to add tungstate ions to the aqueous solution used as a cooling water.

The amount of calcium ions and tungstate ions which should be present in the aqueous solution used as a cooling water and other conditions which are preferably employed in this embodiment may be the same as described above for treatment with the aqueous solution.

It is of course possible according to the present invention to treat tungsten-containing hot mill rolls with an aqueous alkaline calcium ion-containing solution to form a coating of calcium tungstate on the surface of the rolls prior to use and perform hot rolling with the rolls using an aqueous alkaline calcium ion-containing solution as at least part of the cooling water used to cool the rolls. This is advantageous in that the effect of retarding surface toughening of the rolls can be further enhanced.

As demonstrated in the examples, the treatment of a tungsten-containing metallic article according to the present invention is very simple and inexpensive. Nevertheless, it can greatly retard surface toughening of the article and significantly extend the lifetime thereof. In hot rolling using tungsten-containing mill rolls, the lifetime of rolls or the period before roll replacement becomes necessary due to surface roughening can be significantly extended by adding sources of calcium ions and optionally tungstate ions in slight amounts to the cooling water used to cool the rolls in accordance with the present invention. As a result, the frequency of roll dressing is decreased and the efficiency of rolling operation is improved. Since tungsten-containing metallic articles are expensive, the present invention offers significant economies.

The following examples are presented to further illustrate the present invention. These examples are to be considered in all respects as illustrative and not restrictive.

EXAMPLE 1

A mill roll made of a cemented tungsten carbide hard alloy having a chemical composition shown in the foregoing Table 1 is immersed for 24 hours in an aqueous solution at pH 8.5 which was kept at 150° C. and which contained 30 ppm of calcium ions. In the aqueous solution the calcium ions were introduced in the form of calcium sulfate and the pH was adjusted with a boric acid-sodium hydroxide buffer.

After the immersion, the deposit formed on the surface of the roll was analyzed by an X-ray microanalyzer and was found to be a coating of calcium tungstate having a thickness of 40 μm.

A number of mill rolls made of the same hard alloy as above were treated in the same manner as described above to form a coating of calcium tungstate on the surface of each roll. These treated rolls were set on a final stand for finish rolling in a continuous wire-rod mill of 8 stands and hot rolling of a rod was conducted in the final stand under the conditions shown in Table 3 below to reduce the diameter from 7 mm to 5.4 mm.

TABLE 3

| Conditions for Hot Rolling of Wire Rod | |
|---|---|
| Linear speed: | 30 m/sec |
| Rod temperature: | 900° C. |
| Rolling load: | 8 ton |

In hot rolling of wire rod for the manufacture of tire cord wire under these conditions using untreated rolls in the final stand in a conventional manner, the rolls had to be replaced after 2 hours of operation due to surface roughening. By using the above-described rolls which had been treated in accordance with the present invention, the period before roll replacement became necessary could be extended to 3.5 hours.

EXAMPLE 2

Cutting tool tips made of a cemented tungsten carbide hard alloy were immersed for 24 hours in the same calcium ion-containing solution (pH 8.5) as used in Example 1 which was kept at 150° C. to form a coating of calcium tungstate on the surface of each tip.

The treated cutting tool tips were used for roll dressing to machine a cast steel roll having a roll diameter of 300 mm and a barrel length of 500 mm for use in rough rolling of rod wire. A single tip could remove the roll surface radially to a depth of approximately 2 mm.

In contrast, according to a conventional roll dressing procedure in which the same cutting tool tips were used without the above-described treatment, about three tips were required to dress the same cast steel roll as above to a depth of 2 mm. Therefore, the treatment according to the present invention could extend the lifetime of the cutting tool tips by a factor of about three.

EXAMPLE 3

Hot rolling of wire rod was conducted while an aqueous alkaline solution containing calcium ions was used as cooling water in accordance with the present invention. The rolling mill and the hot rolling conditions were the same as described in Example 1 except that untreated rolls made of the cemented tungsten carbide hard alloy were set on the final stand for finish rolling.

During hot rolling, various aqueous solutions having the contents of calcium ions ($Ca^{2+}$) and a pH value shown in Table 4 were sprayed as a cooling water onto all the rolls in the final stand at a rate of 16 $m^3$/h/stand. The source of calcium ions added to the aqueous solution was calcium sulfate and the pH adjustment was effected in the same manner as previously described in Table 2. At the end of 2 hours of hot rolling, the surface of each roll was observed under a scanning electron microscope to determine whether the surface had roughened or not. The results are also shown in Table 4.

TABLE 4

| Run No. | Cooling water pH | Cooling water $Ca^{2+}$ Content | Roll surface after hot rolling |
|---|---|---|---|
| 1 | 8.5 | 10 ppm | No roughening |
| 2 | 8.5 | 20 ppm | No roughening |
| 3 | 8.5 | 30 ppm | No roughening |
| 4 | 8.5 | 50 ppm | No roughening |
| 5 | 9 | 30 ppm | No roughening |
| 6 | 10 | 10 ppm | No roughening |
| 7 | 10 | 20 ppm | No roughening |
| 8 | 10 | 30 ppm | No roughening |
| 9 | 10 | 50 ppm | No roughening |
| 10 | 11 | 30 ppm | No roughening |
| 11 | 7.5 | 30 ppm | Roughening |
| 12 | 8 | 30 ppm | Roughening |
| 13 | 4 | 30 ppm | Roughening |
| 14 | 5 | 30 ppm | Roughening |
| 15 | 7 | 30 ppm | Roughening |
| 16 | 8.5 | 0 ppm | Roughening |
| 17 | 10 | 0 ppm | Roughening |

As can be seen from Table 4, when the aqueous solution used as a cooling water was acidic, neutral, or weak alkaline having a pH value of 8 or less (Runs Nos. 11–15), or even at an alkaline pH greater than 8, when the aqueous solution did not contain calcium ions (Runs Nos. 16 and 17), significant surface roughening was observed on the rolls after hot rolling for 2 hours. In contrast, no surface roughening was observed when the aqueous solution had a pH of greater than 8 and contained calcium ions according to the present invention (Runs. Nos. 1 to 10).

EXAMPLE 4

Rolls made of a tungsten-containing high-speed steel having the chemical composition shown in Table 5 were set on a final stand for finish rolling in a continuous wire-rod mill having 8 stands and hot rolling of a rod was conducted in the final stand under the conditions shown in Table 3 in Example 1 to reduce the diameter from 7 mm to 5.4 mm. During hot rolling, various aqueous solutions having the contents of calcium ions ($Ca^{2+}$) and tungstate ions ($WO_4^{2-}$) and a pH value shown in Table 6 were sprayed as a cooling water onto all the rolls in the final stand at a rate of 16 $m^3/h/stand$. The sources of calcium ions and tungstate ions added to the aqueous solution were calcium sulfate and sodium tungstate, respectively, and the pH adjustment was effected in the same manner as previously described in Table 2. At the end of 2 hours operation of hot rolling, the surface of each roll was observed under a scanning electron microscope to determine whether the surface had roughened or not. The results are also shown in Table 6.

TABLE 5

| Chemical Composition of Test Material (wt %) | | | | | |
|---|---|---|---|---|---|
| W | V | Mo | Cr | C | Fe |
| 10 | 8 | 5 | 6 | 3 | Balance |

TABLE 6

| Run No. | Cooling water pH | $Ca^{2+}$ | $WO_4^{2-}$ | Roll surface after hot rolling |
|---|---|---|---|---|
| 1 | 8.5 | 10 ppm | 20 ppm | No roughening |
| 2 | 8.5 | 20 ppm | 20 ppm | No roughening |
| 3 | 8.5 | 50 ppm | 20 ppm | No roughening |
| 4 | 8.5 | 30 ppm | 20 ppm | No roughening |
| 5 | 8.5 | 30 ppm | 10 ppm | No roughening |
| 6 | 8.5 | 30 ppm | 30 ppm | No roughening |
| 7 | 9 | 30 ppm | 20 ppm | No roughening |
| 8 | 10 | 30 ppm | 20 ppm | No roughening |
| 9 | 11 | 30 ppm | 20 ppm | No roughening |
| 10 | 7.5 | 30 ppm | 20 ppm | Roughening |
| 11 | 8 | 30 ppm | 20 ppm | Roughening |
| 12 | 4 | 30 ppm | 10 ppm | Roughening |
| 13 | 5 | 30 ppm | 10 ppm | Roughening |
| 14 | 7 | 30 ppm | 10 ppm | Roughening |
| 15 | 8.5 | 0 ppm | 0 ppm | Roughening |
| 16 | 8.5 | 30 ppm | 0 ppm | Roughening |
| 17 | 8.5 | 0 ppm | 20 ppm | Roughening |
| 18 | 10 | 0 ppm | 0 ppm | Roughening |

As can be seen from Table 6, when the aqueous solution used as a cooling water was acidic, neutral, or weak alkaline having a pH value of 8 or less (Runs Nos. 10–14), or even at an alkaline pH greater than 8, when the aqueous solution did not contain calcium ions and tungstate ions (Runs Nos. 15 to 18), significant surface roughening was observed on the rolls after hot rolling for 2 hours. In contrast, no surface roughening was observed when the aqueous solution had a pH of greater than 8 and contained calcium ions and tungstate ions according to the present invention (Runs. Nos. 1 to 9).

In this example, the tungsten content of the rolls was as low as 10% by weight and the amount of tungstate ions dissolved from the rolls was not so large. Therefore, tungstate ions had to be present in the cooling water in addition to calcium ions in order to effectively retard surface roughening of the rolls.

It will be appreciated by those skilled in the art that numerous variations and modifications may be made to the invention as described above with respect to specific embodiments without departing from the spirit or scope of the invention as broadly described.

What is claimed is:

1. A method for improving the resistance to surface roughening of tungsten-containing metallic articles, comprising treating a tungsten-containing metallic article with an aqueous alkaline solution containing calcium ions and having a pH greater than 8 so as to form a coating of calcium tungstate on the surface of the metallic article.

2. The method of claim 1, wherein the tungsten content of the metallic article is about 8% by weight or more.

3. The method of claim 1, wherein the tungsten content of the metallic article is about 20% by weight or more.

4. The method of claim 3, wherein the metallic article is made of a cemented tungsten carbide hard alloy.

5. The method of claim 1, wherein the aqueous solution further contains tungstate ions.

6. The method of claim 5, wherein the tungsten content of the metallic article is less than about 20% by weight.

7. The method of claim 6, wherein the metallic article is made of a tungsten-containing high-speed steel.

8. The method of claim 1, wherein the aqueous solution has a pH in the range of 8.5 to 9.

9. The method of claim 1, wherein the content of calcium ions in the aqueous solution is at least 10 ppm.

10. The method of claim 9, wherein the content of calcium ions is in the range of 30 ppm to 80 ppm.

11. The method of claim 5, wherein the content of tungstate ions in the aqueous solution is at least 10 ppm.

12. The method of claim 11, wherein the content of tungstate ions is in the range of 20–50 ppm.

13. The method of claim 1, wherein the metallic article is treated with the aqueous solution at a temperature in the range of 80°–200° C.

14. The method of claim 13, wherein the temperature is in the range of 120°–180° C.

15. The method of claim 1, wherein the metallic article is treated with the aqueous solution for 3–24 hours.

16. A method for retarding surface roughening of tungsten-containing hot mill rolls, comprising substituting an aqueous alkaline solution which contains calcium ions and which has a pH greater than 8 for at least part of the cooling water used to cool the rolls during hot rolling.

17. The method of claim 16, wherein the aqueous solution further contains tungstate ions.

18. The method of claim 16, wherein the rolls are treated with an aqueous calcium ion-containing solution containing calcium ions and having a pH greater than 8 so as to form a coating of calcium tungstate on the surface of the rolls prior to use in hot rolling.

19. The method of claim 16, wherein the rolls are made of a cemented tungsten carbide hard alloy.

20. The method of claim 17, wherein the rolls are made of a tungsten-containing high-speed steel.

* * * * *